343-700 MS AU 251 SA
3/11/86 PR 4,575,725

343/700MS

United States Patent [19]

Tresselt

[11] Patent Number: 4,575,725

[45] Date of Patent: Mar. 11, 1986

[54] DOUBLE TUNED, COUPLED MICROSTRIP ANTENNA

[75] Inventor: Carl P. Tresselt, Towson, Md.

[73] Assignee: Allied Corporation, Morris Township, Morris County, N.J.

[21] Appl. No.: 527,139

[22] Filed: Aug. 29, 1983

[51] Int. Cl.[4] ..... H01Q 1/38
[52] U.S. Cl. ..... 343/700 MS
[58] Field of Search ..... 343/700 MS, 846, 829, 343/793-795, 799, 373; 333/116, 128, 238, 246

[56] References Cited

U.S. PATENT DOCUMENTS

| | | | |
|---|---|---|---|
| 2,996,713 | 8/1961 | Boyer | 343/700 MS |
| 4,054,874 | 10/1977 | Oltman | 343/700 MS |
| 4,070,676 | 1/1978 | Sanford | 343/829 |
| 4,477,813 | 10/1984 | Weiss | 343/700 MS |

FOREIGN PATENT DOCUMENTS 2046530 11/1980 United Kingdom ..... 343/700 MS

OTHER PUBLICATIONS

Dubost, "Theory and Experiments of a Broadband Short-Circuited Microstrip Dipole at Resonance", Proc. of the Workshop on Printed Circuit Antenna Technology, Oct. 12-19, 1979, New Mexico State Univ., Las Cruces, N.M.

*Primary Examiner*—Eli Lieberman
*Assistant Examiner*—Michael C. Wimer
*Attorney, Agent, or Firm*—Markell Seitzman; Russel C. Wells

[57] ABSTRACT

A first antenna for radiating a signal at a predetermined frequency employing at least one ¼ wavelength microstrip resonator positioned below a metal ¼ wavelength radiator. A circularly polarized antenna including a ½ wavelength radiator electromagnetically coupled to a ¼ wavelength resonator is further disclosed.

7 Claims, 8 Drawing Figures

DOUBLE TUNED, COUPLED MICROSTRIP ANTENNA

BACKGROUND AND SUMMARY OF THE INVENTION

This invention relates to antennas and antenna elements comprised of patch dipoles and to a new form of circularly polarized patch antenna.

It is generally known by those practicing antenna design that a flat microstrip or patch dipole antenna arranged parallel to and in close proximity with a ground plane conductor will exhibit a broad side antenna pattern. If two such dipoles are arranged in the same closely spaced relationship parallel to a ground plane conductor and separated from one another by a quarter wave length of their operating frequency and have their feed points connected through a quarter wave length phase delay, the two dipoles will form an end firing antenna element whose antenna pattern will be linearly polarized and directed generally along the line connecting common phase points of the dipoles and in the direction of the phase delay.

Many applications, particularly those in the aerospace and aeronautical fields, require a low-profile antenna. Those familiar with the art will recognize that an entire group of low-profile antennas have been developed to fulfill this need which comprises the socalled printed circuit or patch antenna. It is a known deficiency of these low-profile antennas that the gain-bandwidth product is much too limited for a variety of applications. As an example, in my patent application entitled "Low Profile Circular Array Antenna and Elements Therefor" having Ser. No. 289,851 filed Aug. 4, 1981, now U.S. Pat. No. 4,414,550, such an antenna displayed 2.0 dB of reactive loss at the two operating frequencies of interest. In addition such an array of patch elements requires an isolated power splitter which is required to feed each group of patches to provide an end fire characteristic. It can readily be seen that there is not sufficient room on the bottom side of the ground plane for two tuners and one power splitter for each element of the array.

It is, therefore, an object of the present invention to devise an antenna element which includes its own double-tuning circuitry and does so within the general confines of the patch or radiator dimensions. One such double-tuned antenna element has been proposed by G. Dubost in his paper entitled "Theory and Experiments of Broad Band Short-Circuited Microstrip Dipole at Resonance," 1979 which comprises an air-dielectric structure in which the impedance transformation required to match a 50 ohm line is provided by ¼ wavelength coupled microstrip line printed above the basic airloaded patch. Dubost uses an additional two short circuited ¼ wavelength microstrip stubs to double tune the reactive component of the input impedance. One disadvantage of this design is that the feed structure is on the upper, non-ground plane surface and must be connected via coaxial cable or other means back down through the groundplane for most applications.

In accordance with the more detailed description contained below, the present invention is best illustrated in the context of an eight (8) element antenna array. Each element contains two patch dipoles and its respective microstrip feeds. Power distribution and patch excitation means are located on the top surface of the ground plane and at right angles feeding into the microstrip feed. Double tuning is provided within each patch so that the gain-bandwidth product is enhanced. More particularly, the invention comprises an antenna for radiating a signal at a predetermined frequency or range of frequencies comprising: a ground plane conductor; a ¼ wavelength microstrip resonator including shunt means for connecting thereof a first end ground to said ground plane conductor and a second end adapted to receive the signal; a metal ¼ wavelength radiator having a radiating surface suspended above said resonator by a predetermined distance, said radiating surface, at one edge thereof, electrically connected to said ground plane conductor.

An alternate embodiment of the invention further comprises: a low profile circularly polarized antenna comprising a flat electromagnetically conductive radiator suspended above a ground plane conductor at a predetermined orientation; at least one resonator means for electromagnetically coupling radiation to said at least one radiator means, said at least one resonator partially insulated from and mounted on said ground plane conductor; and means for suspending said radiator at said predetermined orientation above said ground plane including non-electrical and non-magnetical posts.

DETAILED DESCRIPTION OF THE DRAWINGS

Figure 1:
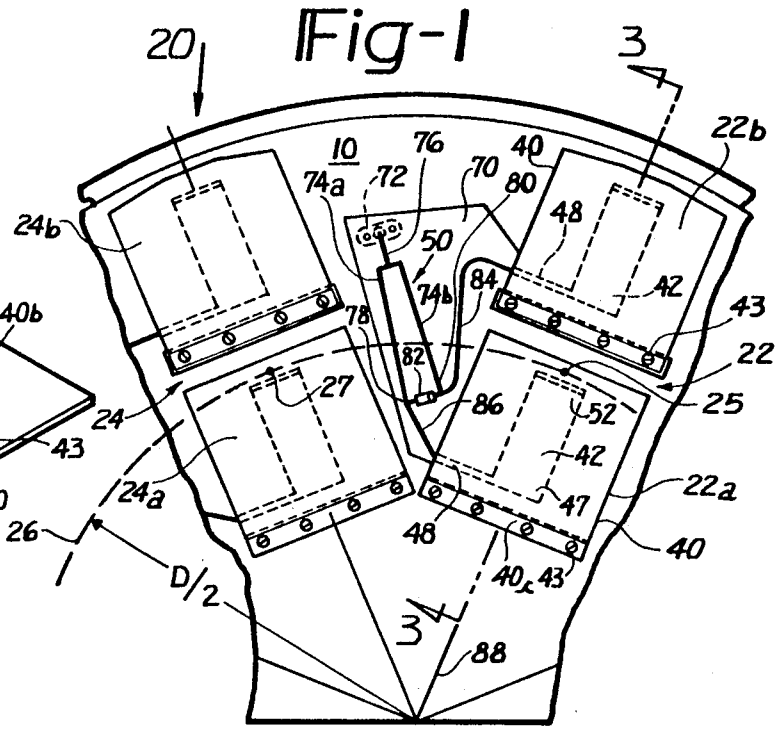
FIG. 1 is a schematic illustration of an antenna using the present invention.

A low profile antenna 10 utilizing the invention as illustrated in FIG. 1 is known by those accomplished in the art. The antenna 10 can be connected to standard electronics to steer the radiated signal or beam as more particularly illustrated in my above-identified patent application which is expressly incorporated herein by reference. These electronics include steering modules and beam forming networks. The antenna 10 consists of a reflector or ground plane conductor 20 upon which is mounted in the preferred embodiment eight symmetrically placed antenna elements. Two of these elements 22 and 24 are illustrated in FIG. 1. These elements are disposed about the ground plane conductor 20 so that their mean phase centers 25, 27 etc. are equally spaced about a circle 26 of diameter D. Each of the eight antenna elements comprises two identical patch dipoles which are identified as having the letters a and b (**22*a*, 22*b***, etc.).

Figure 2:
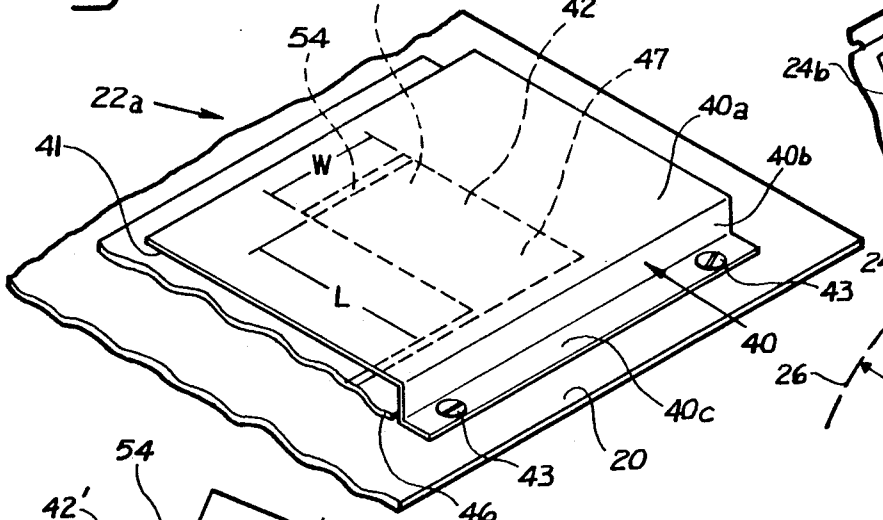
FIG. 2 is a perspective view of part of an antenna element.
Figure 3:
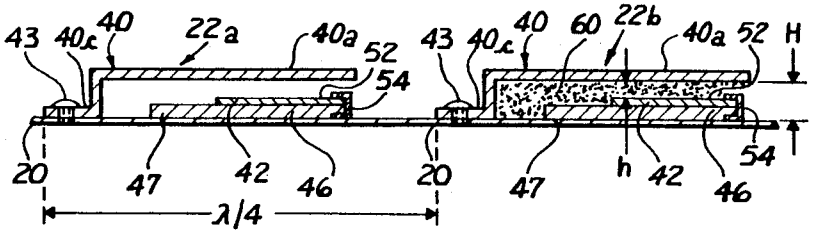
FIG. 3 is a cross-sectional view through section 3—3 of FIG. 1.

A typical patch dipole such as **22*a* is illustrated in greater detail in FIGS. 2 and 3**.

A representative patch dipole such as dipole 22*a* consists of a radiator 40 having a grounded end 40*c*, an upwardly extending member 40*b* and resonating surface 40*a*. The radiator 40 is attached by electrically conductive screws 43 to the ground plane 20 providing electrical connections therebetween. The radiator includes an opposite open circuited edge 41.

The dipole 22*a* is suspended above and in one embodiment completely covers a microstrip resonator 42. The microstrip resonator 42 comprises a copper strip bonded to a standard teflon-fiberglass strip line board 46 upon which the microstrip resonator or patch 42 is printed and electrically isolated from the ground plane conductor 20. The board 46 exhibits a relative dielectric constant of approximately 2.5 for the geometry shown, which dielectrically loads the resonator 42. The microstrip patch 42 which is shown in dotted line in FIGS. 1 and 2 has dimensions L and W chosen to give the microstrip patch 42 an electrical effective length of one quarter wave along the "L" dimension. The microstrip patch 42, as more clearly shown in FIG. 3, comprises a first end 47 which is fed by a microstrip feed 48. Each of the respective microstrip feeds 48 for each patch dipole 22, 24, etc. is connected to a respective power splitter and phase shifting network 50 as shown in FIG. 1. The connection of the power splitter and phase shifting network 50 to the respective feeds of each antenna element (pair of dipoles) is discussed in more detail below. Each microstrip resonator 42 further includes a second end 52 shunted to ground along by a conductive foil or member 54. As illustrated in the above-identified FIGURES, the resonator 42 is separated from the radiator 40 by the dielectric medium of air which essentially provides for no dielectric loading. To increase the structural rigidity of each patch dipole, a low dielectric material 60 having a relative dielectric constant of approximately 1.04 can be positioned between the radiator 40 and the resonator 42 with the radiator 40 positioned a distance "h" above the resonator 42. This dielectric material is shown by way of example in FIG. 3 for dipole 2*ba*.

As previously mentioned, each patch dipole of a particular antenna element receives power from a power splitting and phase network 50. This network is more particularly known to those in the art as a Wilkenson divider and may include a printed circuit board 70 mounted to the top side of the ground plane conductor 20. Power is provided to the underside of the ground plane via a known type of connector 72. The network 50 comprises two quarter wave length bifurcated legs 74*a* and *b* whose 50 ohm junction 76, on one side, is electrically connected to the connector 72. This junction 76 comprises a first port. The other end of each leg 74*a* and *b* comprises second and third ports 78 and 80 that are both connected by a resistor 82. Each of the legs 74*a* and *b* presents a characteristic impedance of approximately 70.7 ohms. The resistor 82 has a value of approximately 100 ohms. The second port 78 is connected by a short 50 ohm strip line 86 to the microstrip feed 48 of dipole 22*a* while port 80 is connected through a 50 ohm quarter wave length segment strip line 84 to the corresponding microstrip feed 48 of dipole 22*b*. In operation a signal is applied via the connector 72 to port 76. The signal is split into two separate but equal and coherent signals at ports 78 and 80, respectively. The signal at port 80 is fed to the patch dipole such as 22*b* and is delayed 90° in phase by the quarter wave length segment 84. Thus the signal at patch dipole 22*a* leads the signal at patch dipole 22*b* by 90°. In the preferred embodiment the shorted or ground end 40 or edges of the respective radiators 40 of the dipole elements are also separated by a quarter wave length, as measured along the radius 88 of the antenna 10. The antenna elements 22 (22*a* and *b*) etc. will end-fire in an outward radial direction. To the first order, reflections from standing waves of the two patch dipoles 22*a* and *b* reach the power splitter ports 78 and 80 with a 180° phase difference and will be absorbed by the resistor 82. In this manner, the dipole feeds 48 of the respective resonators 42 are isolated from one another. The resonant members 40 and 52 form a coupled transmission line pair, in which the individual members are of different characteristic impedances. Opposite ends of the coupled-pair are shorted to ground, by the ground end 40*c* of each patch dipole, and by the shunt 54 of each resonator 42. Such a coupled transmission line pair provides impedance level transformation at resonance. From the rather weak coupling provided in the structures shown, a very substantial transformation from the several thousand ohm effective radiation resistance of each patch 40 to an approximate 50 ohm level at end 47 of each microstrip resonator 42 is provided. At frequencies on either side of resonance, the reactance of the resonator 42 is of opposite sign to itself and to the reactance coupled in from the patch radiator, thereby providing double tuning and increased bandwidth. In this invention, the single resonator 42 provides both double tuning and through coupling, the required impedance for matching, at a location on the groundplane 47 which can readily be accessed via a connector through the groundplane.

Figure 4:
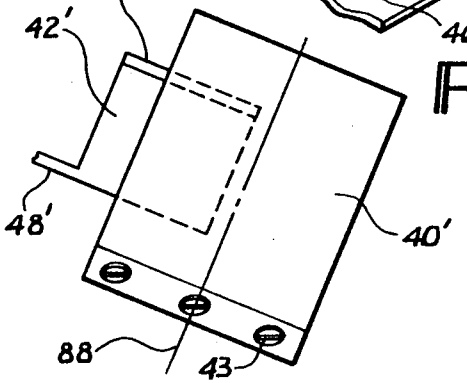
FIG. 4 illustrates an alternate embodiment of the invention.

Reference is very briefly made to FIG. 4 which illustrates an alternate embodiment of the present invention. There is shown a wider microstrip resonator 42' which has been moved off center with respect to the radiator 40'. By such a technique one can increase the amount of reactive slope cancellation provided by the resonator 42', and also decrease the coupling so as to provide a greater impedance transformation for radiator 40' which is of a reduced height above the ground plane, as required in other applications. The resonator can be fed by a microstrip 48' as shown, or by a connector through the groundplane.

Figure 5:
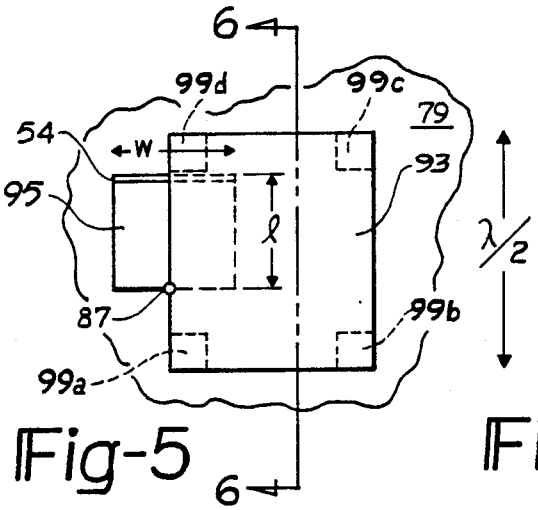
FIG. 5 illustrates another embodiment of the invention.
Figure 6:
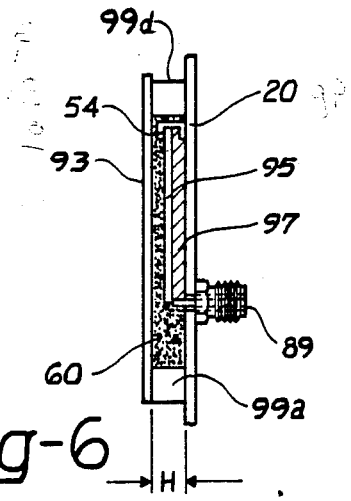
FIG. 6 illustrates a cross-sectional view through section 6—6 of FIG. 5.

Reference is made to FIGS. 5 and 6 which illustrate an alternate embodiment of the invention having linearly polarized characteristics. There is shown a one-half wave length radiator 80 which is fully suspended above and electrically isolated from the ground plane 20. The radiator 93 is excited by a microstrip resonator 95 which may be printed on a fiberglass board 97. One end of the resonator 95 is grounded to the ground plane by a shunt 54 in a manner as discussed above. The feedpoint of the resonator 95 is generally shown at node 87. Connection is made from the underside of the groundplane conductor 20 by a known type of coaxial connector 89. The one-half wave length radiator exhibits a higher Q than does the previously discussed quarter wave length resonator 40'. In order to properly double tune this higher Q element a lower impedance ¼ wavelength resonator was required. This was similarly provided by doubling the width of the microstrip resonator W to approximately 1.45 inches, while maintaining the length, L, at approximately 1.75 inches. These dimensions in the above noted embodiments of the invention correspond to operation centered to cover the air traffic control transponder frequencies of 1030 and 1090

MHZ, with a reactive loss of, at most, a few tenths of one db. in the embodiment illustrated in FIGS. 4–6 only one-half of the microstrip resonator 95 was coupled to the radiator 93. Furthermore, it was found that by placing the radiator 93 at a height, H, of approximately 0.32 inches above the ground plane a satisfactory gain-bandwidth product was displayed.

Reference is briefly made to FIG. 6 which illustrates a cross-sectional view of the one-half wavelength patch dipole illustrated in FIG. 5. More particularly, the radiator 93 is shown suspended above the groundplane 20 and its corresponding resonator 95 by posts 99*a–d* of dielectric material. Alternatively, the dielectric material could be positioned to support the radiator 93 along its entire underside. Power is received by the resonator 95 at node 87 by a known type of connector 89 which may extend through the ground plane conductor 20 thus requiring its corresponding power splitter network if used in an array application to be positioned on the underside of the groundplane conductor. Alternatively, the microstrip feed line can be utilized to connect node 87 to a Wilkinson type network in a manner as discussed for FIGS. 1–5.

Figure 7:
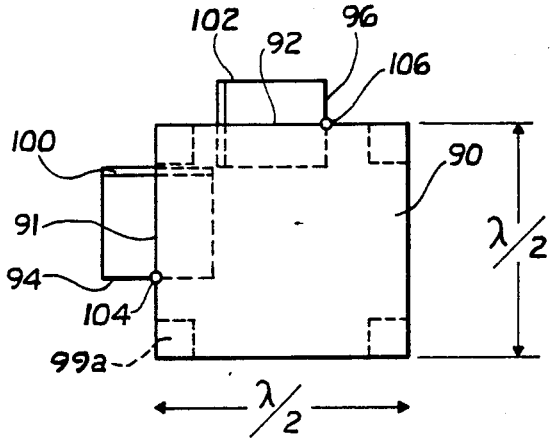
FIG. 7 illustrates a further embodiment of the invention.

The one-half wavelength radiator does exhibit the advantage of having a set of boundary conditions which will permit the creation of a circularly polarized patch antenna. To achieve circular polarization the alternate embodiment of the invention illustrated in FIG. 7 was constructed. In this embodiment a square radiator 90 was utilized. The radiator 90 was excited on two adjacent edges 91 and 92 using a plurality of microstrip resonators 94 and 96. Each respective microstrip was short circuited at ends 100 and 102 in a manner discussed previously. The feed points for the respective microstrip radiators 94 and 96 are illustrated as nodes 104 and 106. The microstrip feedpoints 104 and 106 receive power from a Wilkenson splitter containing an additional 90 degrees length of line in one path, to produce a quadrature pair of feed signals. The radiator 90 is suspended above the ground plane conductor 20 and its corresponding microstrip resonators 91 and 92 in a manner similar to that described in conjunction with FIGS. 5 and 6.

Figure 8:
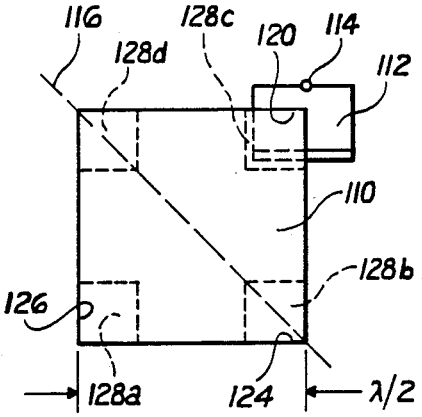
FIG. 8 illustrates a further embodiment of the invention.

Reference is made to FIG. 8 which illustrates an alternate embodiment of the circular polarized patch antenna having enhanced E and H field coupling. The structure of this embodiment of the invention is relatively similar to the embodiments of the invention illustrated in FIGS. 5–6 in that one microstrip resonator 112 is utilized to excite the radiator 110. To achieve enhanced E and H field coupling, the radiator 110 is mounted at a predetermined angular relation relative to the ground plane 20 (not shown in FIG. 8) or to its respective microstrip resonator. More particularly, there is shown a flat radiator 110 suspended above a partially coupled microstrip resonator 112 which extends beyond the periphery of the radiator 110. The feed point of the resonator 112 is illustrated as node 114. The placement of the resonator 112 with respect to the radiator 110 gives rise to both E and H field coupling. As a result of tilting the radiator 110 about an axis 116 which intersects adjacent corners 122 and 124, the corner 126 opposite corner 120, by virtue of the rotation about axis 116, attains the highest placement above the ground plane 20. Four columns 128*a–b* of insulative material support the radiator 110 relative to the ground plane 20. It was found that by using a radiator 110 having dimensions of 3.09 inches by 3.09 inches and by maintaining the height of corner 120 directly above the resonator 112 at 0.08 inches, the opposite corner 126 at 0.18 inches and the remaining two corners at 0.13 inches, combinational E and H field coupling was produced. In this device the two orthogonal linearly polarized fundamental modes of square resonator 112 are excited with equal amplitudes but in time quadrature, which corresponds to circular polarization. The dimensions given correspond to operation centered at 1680 MHZ, a radiosonde band. Performance is inferior to that of the version of FIG. 7, in terms of ellipticity of radiation and operating bandwidth, but for such a simple structure, the bandwidth of 40 MHZ achieved with about 3.5 dB maximum ellipticity by the device in FIG. 8 is significant.

Many changes and modifications in the above-described embodiments of the invention can of course be carried out without departing from the scope thereof. For example, the requirement for equal amplitude, quadrature phase signals to drive two-patch elements in end-fire in the circular array, or for exciting the two orthogonal modes of the square plate radiator in FIG. 7, has been met explicitly by use of the Wilkenson device with an additional quarterwave line in one output. As is well known, a simple −3 dB branch line hybrid in stripline or microstrip can provide the same function, as can a 3 dB parallel-coupled backward wave stripline or microstrip coupler, with form factors suitable for use in low profile arrays of the type being described. Accordingly, that scope is intended to be limited only by the scope of the appended claims.

What is claimed is:

1. An antenna for radiating a signal in a range of frequencies having a predetermined center frequency comprising:

a ground plane conductor;

a microstrip resonator including shunt means for connecting a first end thereof to said ground plane conductor and a second end adapted to receive the signal; said resonator being resonate at a quarter wavelength of said predetermined center frequency, a metal radiator having a radiating surface suspended above said resonator by a predetermined distance, said radiating surface, at one edge thereof, electrically connected to said ground plane conductor, said grounded edge being oriented so as to be on the opposite end generally from the shunt means to ground of said microstrip resonator, said radiator being resonate at substantially a quarter wavelength of said predetermined center frequency whereby the reactance at said second end of the resonator is of opposite sign to that of the reactance coupled in from said radiator at a plurality of frequencies in said range of frequencies.

2. The antenna as defined in claim 1 wherein said resonator comprises:

an insulator plate having a predetermined relative dielectric constant, mounted to said ground plane conductor;

a conductive patch mounted to said insulator plate terminating at said first end;

a conductive member enveloping said conductive patch at said first end, for electrically connecting said patch at said first end to said ground plane conductor.

3. The antenna as defined in claim 2 wherein said radiator comprises:

a rectangular shaped flat conductor larger than said conductive patch;

a shoulder element adapted to be mounted to said ground plane conductor; and an extending member connecting at said one edge thereof said shoulder to said flat conductor.

4. The antenna as defined in claim 3 wherein an edge of said resonator extends partially beyond a non-radiating edge of said radiator whereby the resonator has a predetermined reactance as a function of frequency and whereby said radiator has a predetermined coupling to said resonator.

5. A low profile circular array antenna resonant at a design frequency comprising:

a ground plane conductor;

a plurality of N antenna elements, each comprising at least two electromagnetically coupled patch dipoles, each said dipole being comprised of a flat rectangular conductive radiator arranged parallel to said ground plane conductor and spaced a predetermined distance above a conductive resonator and electrically shunted along one edge to said ground plane, said radiator including a second edge oppositely situated relative to said one edge and open circuited with respect to said ground plane conductor, said resonator comprising a flat conductive plate shunted to said ground plane conductor along a first end oppositely positioned relative to said one edge of said radiator, said resonator further comprising a second end including a feedpoint, the dipoles comprising an antenna element being arranged on a radial line from a common center on said ground plane conductor, there being N equally spaced radial lines from said common center, one of said radial lines for each said antenna element, the shunted edge of each radiator lying on a particular one of said radial lines and having its respective second edge outwardly directed along a particular one of said radial lines, and wherein the respective shunted edges of each pair of dipoles are spaced a predetermined distance equivalent to one-fourth wave length at said design frequency;

a plurality of N isolated power splitter means, one for each antenna element, having at least first, second and third ports, the power at said first port being split to said second and third ports, and including means for electrically isolating said second and third ports and additionally including first means for connecting said second port to the feedpoint of one of said dipoles of the associated antenna element and second means for connecting said third port to the feedpoint of the other of said dipoles of the same associated antenna element, each said power splitter means including means for shifting the phase of a signal of said design frequency at the feedpoint of said one dipole with respect to the signal of said design frequency at the feedpoint of said other of said dipoles by a phase angle equivalent to one-fourth wave length.

6. The low profile circular array antenna of claim 5 wherein a typical antenna element has a phase center, the phase centers of said N antenna elements being disposed on a circle concentric with said common center.

7. The low profile circular array antenna of claim 5 wherein a typical power splitter means comprises a substrate having two legs of equal length, each leg terminating at one end at said first port, the first leg terminating at its other end at said second port and the second leg terminating at its other end at said third port, a resistor is connected between said second and third ports, said first and second means for connecting comprising first and second lengths of strip line connecting said second and third ports to the feedpoints of said dipoles respectively, the difference in length of said second means for connecting with respect to said first means for connecting providing a 90° phase delay wherein the impedance of each said leg of the phase splitter means is 70.7 ohms and the impedance of each said means for connecting is 50 ohms.

* * * * *